US008762139B2

(12) United States Patent
Furuta et al.

(10) Patent No.: US 8,762,139 B2
(45) **Date of Patent: *Jun. 24, 2014**

(54) NOISE SUPPRESSION DEVICE

(75) Inventors: Satoru Furuta, Tokyo (JP); Hirohisa Tasaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/814,332

(22) PCT Filed: Sep. 21, 2010

(86) PCT No.: PCT/JP2010/005711

§ 371 (c)(1),
(2), (4) Date: Feb. 5, 2013

(87) PCT Pub. No.: WO2012/038998

PCT Pub. Date: Mar. 29, 2012

(65) Prior Publication Data

US 2013/0138434 A1 May 30, 2013

(51) Int. Cl.
*G10L 21/00* (2013.01)

(52) U.S. Cl.
USPC ..... 704/226; 704/205; 704/206; 704/207; 704/208; 704/214

(58) Field of Classification Search
USPC ..... 704/205–209, 214, 226
See application file for complete search history.

(56) References Cited

U.S. PATENT DOCUMENTS

| | | | | |
|---|---|---|---|---|
| 7,286,980 | B2 * | 10/2007 | Wang et al. | 704/205 |
| 7,349,841 | B2 | 3/2008 | Furuta et al. | |
| 2003/0023430 | A1 * | 1/2003 | Wang et al. | 704/226 |
| 2004/0128130 | A1 * | 7/2004 | Rose et al. | 704/236 |

(Continued)

FOREIGN PATENT DOCUMENTS

| | | |
|---|---|---|
| JP | 2001 344000 | 12/2001 |
| JP | 2004 341339 | 12/2004 |

(Continued)

OTHER PUBLICATIONS

Lotter, T., et al., "Speech Enhancement by MAP Spectral Amplitude Estimation Using a Super-Gaussian Speech Model," EUEASIP Journal on Applied Signal Processing, vol. 2005, No. 7, pp. 1110-1126, (2005).

(Continued)

*Primary Examiner* — Leonard Saint Cyr
(74) *Attorney, Agent, or Firm* — Oblon, Spivak, McClelland, Maier & Neustadt, L.L.P.

(57) ABSTRACT

A noise suppression device includes: a power spectrum calculator converting an input signal of time domain into power spectra of frequency domain; a voice/noise determination unit determining whether the power spectra indicate voice or noise; a noise spectrum estimation unit estimating noise spectra of the power spectra; a period component estimation unit analyzing a harmonic structure constituting the power spectra and estimating periodical information about the power spectra; a weighting coefficient calculator calculating a weighting coefficient for weighting the power spectra; a suppression coefficient calculator calculating a suppression coefficient for suppressing noise included in the power spectra; a spectrum suppression unit suppressing amplitude of the power spectra in accordance with the suppression coefficient; and an inverse Fourier transformer converting the power spectra output by the spectrum suppression unit into a signal of time domain to generate a noise-suppressed signal.

5 Claims, 6 Drawing Sheets

(56) References Cited

U.S. PATENT DOCUMENTS

| | | | | |
|---|---|---|---|---|
| 2008/0077399 | A1 | 3/2008 | Yoshida | |
| 2008/0162122 | A1* | 7/2008 | Rose et al. | 704/203 |
| 2008/0243496 | A1 | 10/2008 | Wang | |
| 2008/0281589 | A1 | 11/2008 | Wang et al. | |
| 2011/0015931 | A1* | 1/2011 | Kawahara et al. | 704/264 |
| 2011/0125490 | A1 | 5/2011 | Furuta et al. | |
| 2013/0003987 | A1 | 1/2013 | Furuta et al. | |

FOREIGN PATENT DOCUMENTS

| | | |
|---|---|---|
| JP | 2006 113515 | 4/2006 |
| JP | 2008 76988 | 4/2008 |
| JP | 2008 129077 | 6/2008 |
| JP | 2006 201622 | 8/2008 |
| WO | 2005 124739 | 12/2005 |

OTHER PUBLICATIONS

Ephraim, Y., et al., "Speech Enhancement Using a Minimum Mean-Square Error Short-Time Spectral Amplitude Estimator," IEEE Transactions on Acoustics, Speech, and Signal Processing, vol. ASSP-32, No. 6, pp. 1109-1121, (Dec. 1984).

Boll, S., "Suppresion of Acoustic Noise in Speech using Spectral Subtraction," IEEE Transactions on Acoustics, Speech, and Signal Processing, vol. AASSP-27, No. 2, pp. 113-120, (Apr. 1979).

* cited by examiner (a) Weighting Process is Not Performed (b) Weighting Process is Performed

NOISE SUPPRESSION DEVICE

TECHNICAL FIELD

This invention relates to a noise suppression device which is used for improving a recognition rate of a voice recognition system and improving sound quality of a car navigation, a mobile phone, a voice communication system such as an intercom, a hands-free communication system, a TV conference system, and a monitoring system, and, to which a voice communication, a voice storage, and a speech recognition system are introduced. The noise suppression device is adapted to suppress background noise mixed with an input signal.

BACKGROUND ART

Along with recent advancement of digital signal processing techniques, outdoor voice communication with mobile phones, hands-free voice communication in cars, and hands-free operation with voice recognition are widely available. Since those apparatuses are often used under high-noise environments, background noise is input to a microphone together with voice. This situation brings deterioration of a quality of voice communication and a voice recognition rate. In order to achieve highly accurate voice recognition and comfortable voice communication, a noise suppression device for suppressing the background noise mixed with the input signal is required.

An example of conventional noise suppression method is disclosed in, for example, Non-Patent Literature 1. The conventional method includes converting an input signal of time domain into power spectra which is a signal of frequency domain, calculating a suppression amount for noise suppression using power spectra of the input signal and estimated noise spectra that is estimated separately from the input signal, performing amplitude suppression of the power spectra of the input signal using the suppression amount, converting the amplitude-suppressed power spectra and the phase spectra of the input signal into time domain, and obtaining a noise suppression signal.

According to the conventional noise suppression method, the suppression amount is calculated based on the ratio of the voice power spectra to the estimated noise power spectra (SN ratio). However, when the suppression amount indicates a negative value (in decibel), a correct suppression amount cannot be obtained. For example, in a voice signal overlaid with a car cruising noise having a high power in a low frequency region, the low frequency region of voice is buried in the noise. In this case, the SN ratio becomes negative, and as a result, there is a problem in that the low frequency region of the voice signal is excessively suppressed to cause voice quality degradation.

In order to solve the foregoing problem, a conventional method for generating and recovering a low frequency region signal that has been lost is disclosed in, for example, Patent Literature 1. This conventional art discloses a voice signal processing apparatus that extracts some of harmonics components of a fundamental frequency (pitch) signal of voice from an input signal, generates subharmonics components by multiplying the extracted harmonics components by two, and overlays the obtained sub-harmonics components on the input signal, thus obtains a voice signal of which voice quality has been improved. By placing the voice signal processing apparatus in a stage subsequent to a noise suppression device, the noise suppression device having superior low frequency region components can be achieved.

CITATION LIST

Patent Literature

Patent Literature 1: Japanese Patent Laid-Open No. 2008-76988 (pages 5 to 6, FIG. 1)

Non-Patent Literature

Non-Patent Literature 1: Y. Ephraim, D. Malah, "Speech Enhancement Using a Minimum Mean Square Error Short-Time Spectral Amplitude Estimator", IEEE Trans. ASSP, vol. ASSP-32, No. 6 Dec. 1984

SUMMARY OF THE INVENTION

However, in the conventional voice signal processing apparatus disclosed in Patent Literature 1, the low frequency region signal is analyzed and generated from an input signal. Therefore, when the input signal includes remaining noise, i.e., when the output signal of the noise suppression device includes the remaining noise, the low frequency region component is affected by the remaining noise. This situation may cause a problem that the voice quality is suddenly degraded. Further, there is a problem that a large amount of calculation and memory are required for generation of the low frequency region component, filtration processing, and control of the degree of overlay of the low frequency region component.

This invention is made to solve the above problems, and has an object to provide a noise suppression device which is capable of achieving a high quality with simple processing.

A noise suppression device according to this invention includes: a power spectrum calculator configured to convert an input signal of time domain into power spectra as a signal of frequency domain; a voice/noise determination unit configured to determine whether the power spectra indicate voice or noise; a noise spectrum estimation unit configured to estimate noise spectra of the power spectra by using a determination result of the voice/noise determination unit; a period component estimation unit configured to analyze a harmonic structure constituting the power spectra, and estimate periodical information about the power spectra; a weighting coefficient calculator configured to calculate a weighting coefficient for weighting the power spectra by using the periodical information, the determination result of the voice/noise determination unit, and signal information about the power spectra; a suppression coefficient calculator configured to calculate a suppression coefficient for suppressing noise included in the power spectra by using the power spectra, the determination result of the voice/noise determination unit, and the weighting coefficient; a spectrum suppression unit configured to suppress amplitude of the power spectra in accordance with the suppression coefficient; and a transformer configured to convert the power spectra whose amplitude has been suppressed by the spectrum suppression unit into a signal of time domain to generate a noise-suppressed signal.

According to this invention, the noise suppression device is provided with: the period component estimation unit configured to analyze a harmonic structure constituting the power spectra, and estimate periodical information about the power spectra; the weighting coefficient calculator configured to calculate a weighting coefficient for weighting the power spectra by using the periodical information, the determination result of the voice/noise determination unit, and signal information about the power spectra; the suppression coefficient calculator configured to calculate a suppression coefficient for suppressing noise included in the power spectra by using the power spectra, the determination result of the voice/noise determination unit, and the weighting coefficient; and the spectrum suppression unit configured to suppress amplitude of the power spectra in accordance with the suppression coefficient. Therefore, even in a frequency band where the voice is buried in the noise, correction can be made to maintain the harmonic structure of voice, excessive suppression of the voice can be avoided, and high quality noise suppression can be achieved.

DESCRIPTION OF EMBODIMENTS

Hereinafter, embodiments of the present invention will be explained with reference to appended drawings.

Embodiment 1

Figure 1:
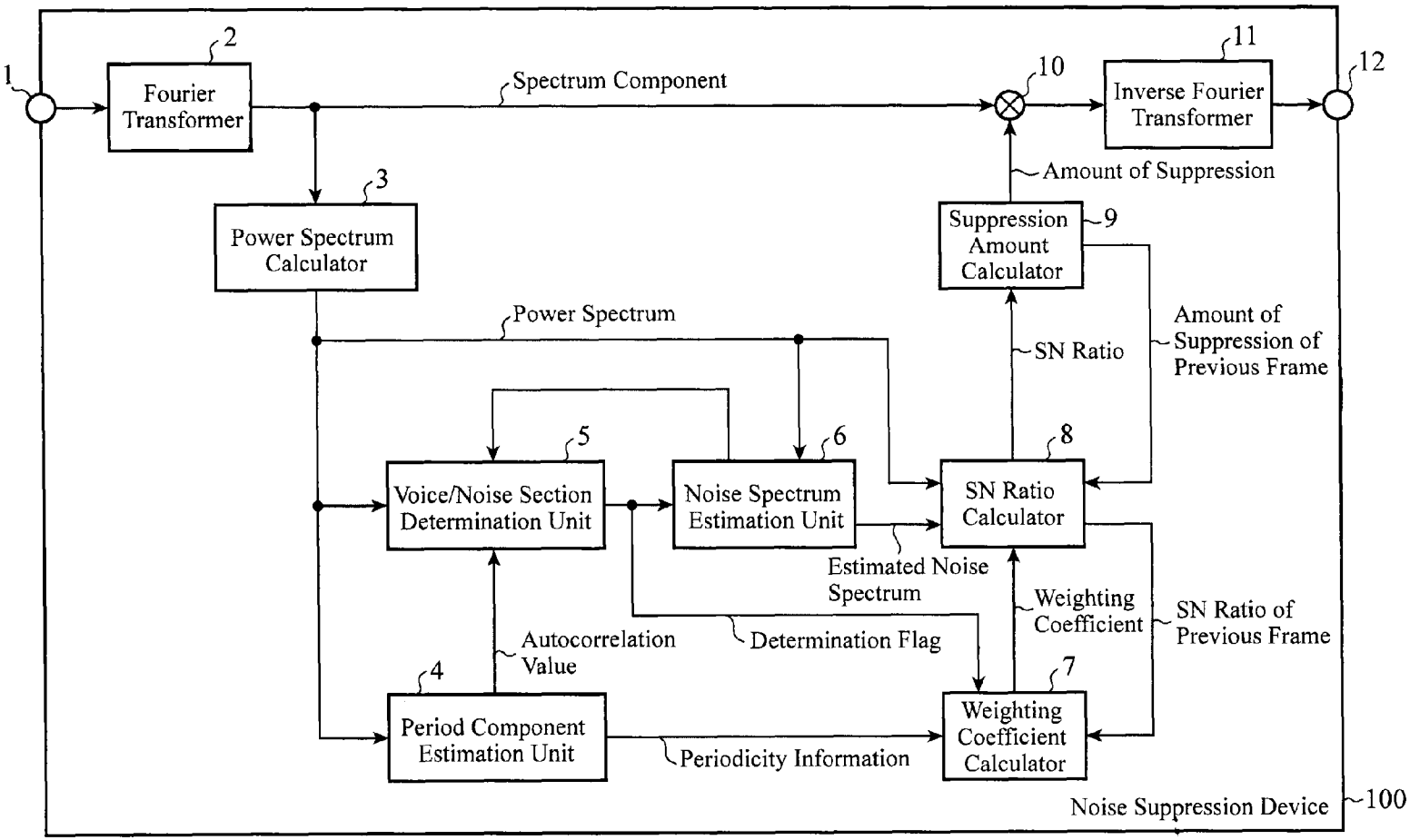
FIG. 1 is a block diagram illustrating a configuration of a noise suppression device according to Embodiment 1.

FIG. 1 is a block diagram illustrating a configuration of a noise suppression device according to Embodiment 1 of this invention.

The noise suppression device 100 includes an input terminal 1, a Fourier transformer 2, a power spectrum calculator 3, a period component estimation unit 4, a voice/noise section determination unit (voice/noise determination unit) 5, a noise spectrum estimation unit 6, a weighting coefficient calculator 7, an SN ratio calculator (suppression coefficient calculator) 8, a suppression amount calculator 9, a spectrum suppression unit 10, an inverse Fourier transformer (transformer) 11, and an output terminal 12.

Hereinafter, the principle of operation of the noise suppression device 100 will be explained with reference to FIG. 1.

Processes are preliminarily performed on voice, music, and the like retrieved through a microphone (not shown) to implement an A/D (analog/digital) conversion, a sampling at a predetermined sampling frequency (for example, 8 kHz), and a partition of the sampled data into units of frames (for example, 10 ms). The frames are input to the noise suppression device 100 through the input terminal 1.

The Fourier transformer 2 applies Harming window or the like to the input signal, and implements Fast Fourier Transform at, for example, 256 points through a formula (1) shown below to transform the input signal of time domain into spectral components X(λ, k).

$$X(\lambda,k)=\mathrm{FT}[x(t)] \tag{1}$$

In this formula, "λ" denotes a frame number applied to the input signal divided into frames, "k" denotes a number designating a frequency component in a frequency band of power spectra (hereinafter referred to as "a spectrum number"), and "FT[ . . . ]" denotes the Fourier transform.

The power spectrum calculator 3 obtains power spectra Y(λ,k) from the spectral components of the input signal through a formula (2) shown below.

$$Y(\lambda,k)=\sqrt{\mathrm{Re}\{X(\lambda,k)\}^2+\mathrm{Im}\{X(\lambda,k)\}^2};\ 0\leq k<128 \tag{2}$$

Note that "Re{X(λ,k)}" and "Im{X(λ,k)}" denote a real part and an imaginary part, respectively, of the input signal spectra after the Fourier transform.

Figure 2:
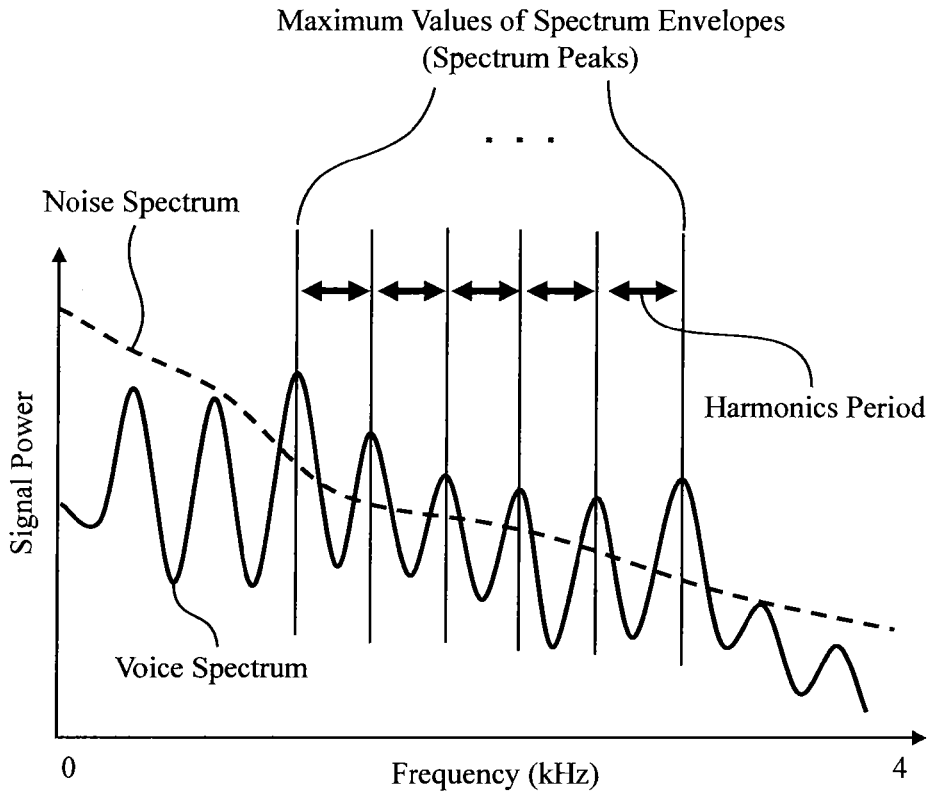
FIG. 2 is an explanatory diagram schematically illustrating harmonic structure detection of voice by a period component estimation unit of the noise suppression device according to Embodiment 1.

The period component estimation unit 4 inputs the power spectra Y(λ,k) output from the power spectrum calculator 3, and analyzes the harmonic structure of the input signal spectra. As shown in FIG. 2, the harmonic structure is analyzed by detecting a peak of the harmonic structure constituted by the power spectra (hereinafter referred to as "a spectral peak"). More specifically, in order to remove small peak components which are not concerned with the harmonic structure, for example, 20% of the maximum value of the power spectra is subtracted from each power spectral component. After that, the maximum value of the spectra envelope of the power spectra is found by tracking in order from the low frequency region. For simplifying the explanation, in the example of the power spectra of FIG. 2, the voice spectra and the noise spectra are described as separate components. However, since an actual input signal has voice spectra overlaid (or added) with noise spectra, it is impossible to observe a peak of the voice spectra whose power is less than that of the noise spectra.

By searching the spectral peaks, periodical information p(λ,k) is set for each spectrum number k. The periodical information "p(λ,k)=1" is set to the maximum value of the power spectra (which is the spectral peak), whereas "p(λ,k)=0" is set to the others. Although all the spectral peaks are extracted in the example of FIG. 2, the spectral peaks can be extracted only in a particular frequency band, for example, only in a frequency band having a higher SN ratio.

Figure 3:
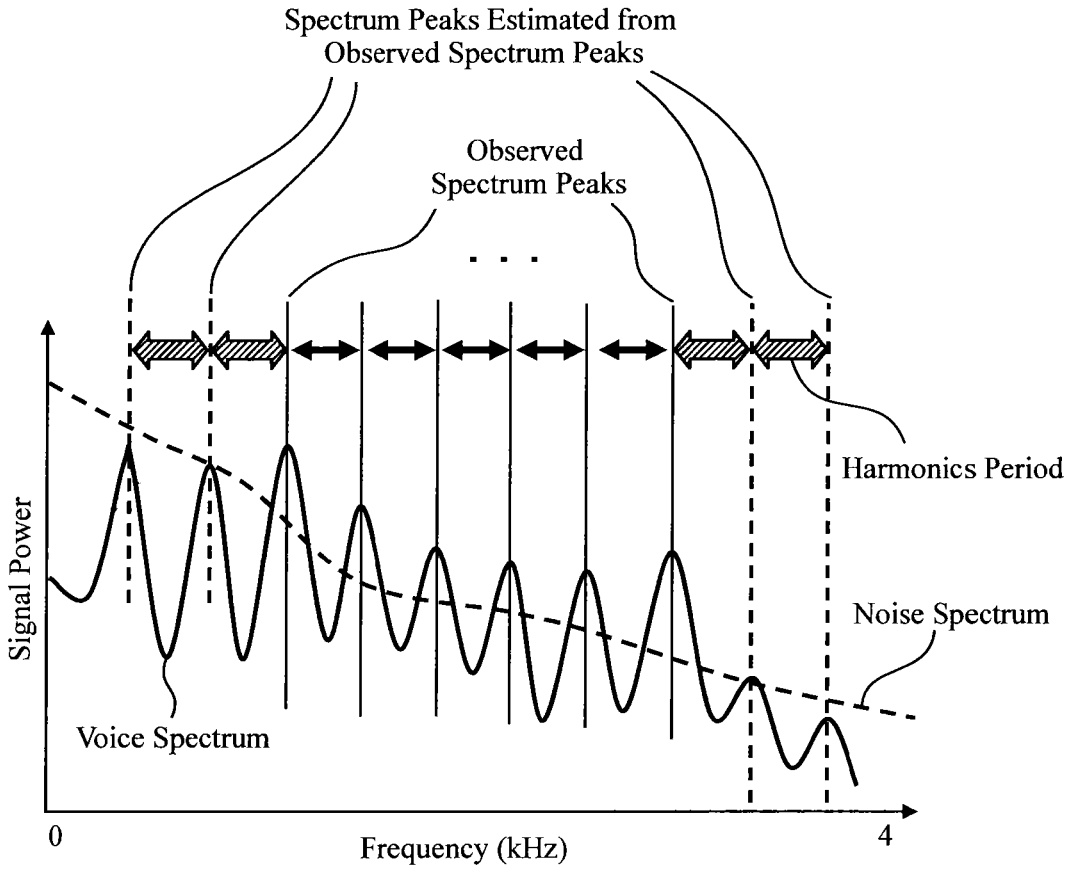
FIG. 3 is an explanatory diagram schematically illustrating harmonic structure correction of voice by a period component estimation unit of the noise suppression device according to Embodiment 1.

Subsequently, based on a harmonics period of the observed spectral peaks, the peaks of the voice spectra buried in the noise spectra are estimated. More specifically, as shown in FIG. 3, with respect to sections in which no spectral peaks are observed (i.e. sections of the low frequency region and/or the high frequency region which are buried in the noise), it is assumed that spectral peaks exist with the harmonics period of the observed spectral peaks (i.e. peak interval). The periodical information p(λ,k) of the spectrum number for each of the assumed spectral peaks is set as "1". Since the voice component rarely exists in an extremely low frequency band (for example, 120 Hz or less), there may be no need to set the periodical information p(λ,k) as "1" to such low frequency band. The same matter can also be applied in an extremely high frequency band.

A normalized autocorrelation function $\rho_N(\lambda,\tau)$ is obtained from the power spectra $Y(\lambda,k)$ through a formula (3) show below.

$$\rho(\lambda, \tau) = FT[Y(\lambda, k)] \quad (3)$$

$$\rho_N(\lambda, \tau) = \frac{\rho(\lambda, \tau)}{\rho(\lambda, 0)}$$

In this formula, "$\tau$" denotes a delay time, and "FT[ . . . ]" denotes a Fourier transform process. A Fast Fourier Transform may be performed with the same point number "256" as that of the formula (1). Since the formula (3) is Wiener-Khintchine theorem, details thereof are omitted. Subsequently, the maximum value $\rho_{max}(\lambda)$ of the normalized autocorrelation function is obtained through a formula (4). The formula (4) represents a search for the maximum value with respect to $p(\lambda,r)$ within the range of $16 \le \tau \le 96$.

$$\rho_{max}(\lambda)=\max[\rho(\lambda,\tau)],\ 16 \le \tau \le 96 \quad (4)$$

The obtained periodical information $p(\lambda,\tau)$ and the maximum value of the autocorrelation function $\rho_{max}(\lambda)$ are respectively output. The periodicity can be analyzed not only through peak analysis of the power spectra and the autocorrelation function taught in above, but also through any well-known methods such as Cepstrum analysis.

The voice/noise section determination unit 5 inputs the power spectra $Y(\lambda,k)$ output from the power spectrum calculator 3, the maximum value of the autocorrelation function $\rho_{max}(\lambda)$ output from the period component estimation unit 4, and noise spectra $N(\lambda,k)$ output from the noise spectrum estimation unit 6, which will be explained later. The voice/noise section determination unit 5 determines whether the input signal of the current frame indicates voice or noise, and outputs a result of the determination as a determination flag. An example of the determination method of the voice/noise section can be given as follows. When one of or both of a formula (5) and a formula (6) shown below are satisfied, the input signal is determined to be voice, and a Vflag indicating "1 (voice)" as the determination flag is set and output. In the other cases, the input signal is determined to be noise, and a Vflag indicating "0 (noise)" as the determination flag is set and output.

$$Vflag = \begin{cases} 1; & \text{if } 20 \cdot \log_{10}(S_{pow}/N_{pow}) > TH_{FR_SN} \\ 0; & \text{if } 20 \cdot \log_{10}(S_{pow}/N_{pow}) \le TH_{FR_SN} \end{cases} \quad (5)$$

$$\text{where, } S_{pow} = \sum_{k=0}^{127} Y(\lambda, k),\ N_{pow} = \sum_{k=0}^{127} N(\lambda, k)$$

$$Vflag = \begin{cases} 1; & \text{if } \rho_{max}(\lambda) > TH_{ACF} \\ 0; & \text{if } \rho_{max}(\lambda) \le TH_{ACF} \end{cases} \quad (6)$$

In the formula (5), "$N(\lambda,k)$" denotes an estimated noise spectra, and "$S_{pow}$" and "$N_{pow}$" denote a summation of power spectra of the input signal and a summation of estimated noise spectra, respectively. "$TH_{FR_SN}$" and "$TH_{ACF}$" denote predetermined constant thresholds for the determination. In a preferred example, "$TH_{FR_SN}$=3.0" and "$TH_{ACF}$=0.3" may be given, however, they can be changed depending on a state of the input signal and a noise level.

The noise spectrum estimation unit 6 inputs the power spectra $Y(\lambda,k)$ output by the power spectrum calculator 3 and the determination flag Vflag output by the voice/noise section determination unit 5. The noise spectrum estimation unit 6 estimates and updates the noise spectra through the determination flag Vflag and a formula (7) shown below, and outputs the estimated noise spectra $N(\lambda,k)$.

$$N(\lambda, k) = \begin{cases} (1-\alpha) \cdot N(\lambda-1, k) + \alpha \cdot |Y(\lambda, k)|^2 & \text{if } Vflag = 0 \\ N(\lambda-1, k) & \text{if } Vflag = 1; \end{cases} \quad (7)$$

$$0 \le k \le 128$$

In this formula, "$N(\lambda-1,k)$" denotes an estimated noise spectra of a previous frame, which has been stored in a storage unit such as a RAM (Random Access Memory) in the noise spectrum estimation unit 6. When the determination flag indicates "Vflag=0" in the formula (7), the input signal of the current frame is determined to be noise. In this case, the estimated noise spectra $N(\lambda-1,k)$ of the previous frame is updated by using an update coefficient "$\alpha$" and the power spectra $Y(\lambda,k)$ of the input signal. Note that the update coefficient $\alpha$ is a predetermined constant within a range of $0<\alpha<1$. In a preferable example, $\alpha$ is 0.95, but can be changed depending on a state of the input signal and a noise level.

On the other hand, when the determination flag indicates "Vflag=1" in the formula (7), the input signal of the current frame is determined to be voice. In this case, the estimated noise spectra $N(\lambda-1,k)$ of the previous frame is output as the estimated noise spectra $N(\lambda,k)$ of the current frame.

The weighting coefficient calculator 7 inputs the periodical information $p(\lambda,k)$ output from the period component estimation unit 4, the determination flag Vflag output from the voice/noise section determination unit 5, and an SN ratio (signal-to-noise ratio) for each spectral component, which is output from the SN ratio calculator 8 explained later. The weighting coefficient calculator 7 calculates a weighting coefficient $W(\lambda,k)$ for weighting the SN ratio for each spectral component.

$$W(\lambda, k) = \begin{cases} (1-\beta) \cdot W(\lambda-1, k) + \beta \cdot w_P(k) & \text{if } p(\lambda, k) = 1 \\ (1-\beta) \cdot W(\lambda-1, k) + \beta \cdot w_Z(k) & \text{if } p(\lambda, k) = 0; \end{cases} \quad (8)$$

$$0 \le k \le 128$$

In this formula, "$W(\lambda-1,k)$" denotes a weighting coefficient of a previous frame, and "$\beta$" denotes a predetermined constant for smoothing. Preferably, $\beta$ is 0.8. "$w_p(k)$" denotes a weighting constant, which is calculated through, for example, a formula (9) shown below. Namely, "$w_p(k)$" is determined by the SN ratio for each spectral component and the determination flag, and is smoothed with a value of $w_p(k)$ at the spectrum number k and values at adjacent spectrum numbers. Upon smoothing with the adjacent spectral components, there are advantages of suppressing steepening of the weighting coefficient and absorbing error in the spectral peak analysis.

Note that, under normal circumstances, a weighting constant $w_Z(k)$ for "$p(\lambda,k)=0$" can be 1.0 without weighting. However, it may be possible to control $w_Z(k)$ in the same manner as $w_p(k)$, that is, control it depending on the SN ratio for each spectral component and the determination flag.

$$w_P(k) = \begin{cases} 0.25 \cdot \hat{w}_P(k-1) + 1.25 \cdot \hat{w}_P(k) + 0.25 \cdot \hat{w}_P(k+1), & 1 \le k < 127 \\ \hat{w}_P(k), & k = 0, 127 \end{cases} \quad (9)$$

When the periodical information indicates "p(λ,k)=1" and the determination flag indicates "Vflag=1 (voice)", the following is applied to the weighting constant.

$$\hat{w}_P(k) = \begin{cases} 1.0 & \text{if } snr(k) \geq TH_{SB_SNR} \\ 4.0 & \text{if } snr(k) < TH_{SB_SNR}; \end{cases}$$

$$0 \leq k < 128$$

And, when the periodical information indicates "p(λ,k)=1" and the determination flag indicates "Vflag=0 (noise)", the following is applied to the weighting constant.

$$\hat{w}_P(k) = \begin{cases} 1.5 & \text{if } snr(k) \geq TH_{SB_SNR} \\ 1.0 & \text{if } snr(k) < TH_{SB_SNR}; \end{cases}$$

$$0 \leq k < 128$$

Note that, "snr(k)" denotes an SN ratio for each spectral component output from the SN ratio calculator 8, and "$TH_{SB_SNR}$" denotes a predetermined constant threshold. When the input signal is determined to be voice by controlling the weighting constant with the SN ratio for each spectral component and the determination flag through the formula (9), the weighting is performed as follows. A large weighting is performed on a spectral peak (i.e. a peak portion of a harmonic structure of the spectra) in a frequency band where voice is buried in noise, whereas excessive weighting is not given for a spectral component in a frequency band where the SN ratio is originally high. On the other hand, when the input signal is determined to be noise, an inhibited weighting (e.g. the weighting constant is set as "1.0") is performed on a spectral component whose SN ratio is estimated as being high. By such weighting control, even when the determination flag is incorrect such that the current frame being voice is determined to be noise, the weighting can be performed on the current frame which has been given the incorrect flag. The threshold value $TH_{SB_SNR}$ can be changed depending on a state of the input signal and a noise level.

The SN ratio calculator 8 calculates a posteriori SNR and a priori SNR for each spectral component by using the power spectra Y(λ,k) output from the power spectrum calculator 3, the estimated noise spectra N(λ,k) output from the noise spectrum estimation unit 6, the weighting coefficient W(λ,k) output from the weighting coefficient calculator 7, and a spectrum suppression amount G(λ−1,k) of a previous frame, which is output from the suppression amount calculator 9 explained later.

The posteriori SNR γ(λ,k) can be calculated through a formula (10) shown below, which uses the power spectra Y(λ,k) and the estimated noise spectra N(λ,k). By giving a weighting based on the formula (9) shown above, a correction can be made so that the posteriori SNR is estimated to be higher at the spectral peak.

$$\gamma(\lambda, k) = \frac{W(\lambda, k) \cdot |Y(\lambda, k)|^2}{N(\lambda, k)} \tag{10}$$

The priori SNR ξ(λ,k) is calculated through a formula (11) shown below, which uses the spectrum suppression amount G(λ−1,k) of the previous frame and the posteriori SNR γ(λ−1,k) of the previous frame.

$$\xi(\lambda, k) = \delta \cdot \gamma(\lambda - 1, k) \cdot G^2(\lambda - 1, k) + (1 - \delta) \cdot F[\gamma(\lambda, k) - 1] \tag{11}$$

$$\text{where, } F[x] = \begin{cases} x, & x > 0 \\ 0, & \text{else} \end{cases}$$

In this formula, "δ" denotes a predetermined constant within a range of 0<δ<1. In the present embodiment, δ is preferably 0.98. Furthermore, "F[ . . . ]" denotes a half-wave rectifier, and performs a flooring to zero when the posteriori SNR indicates a negative value in decibel.

Figure 4:
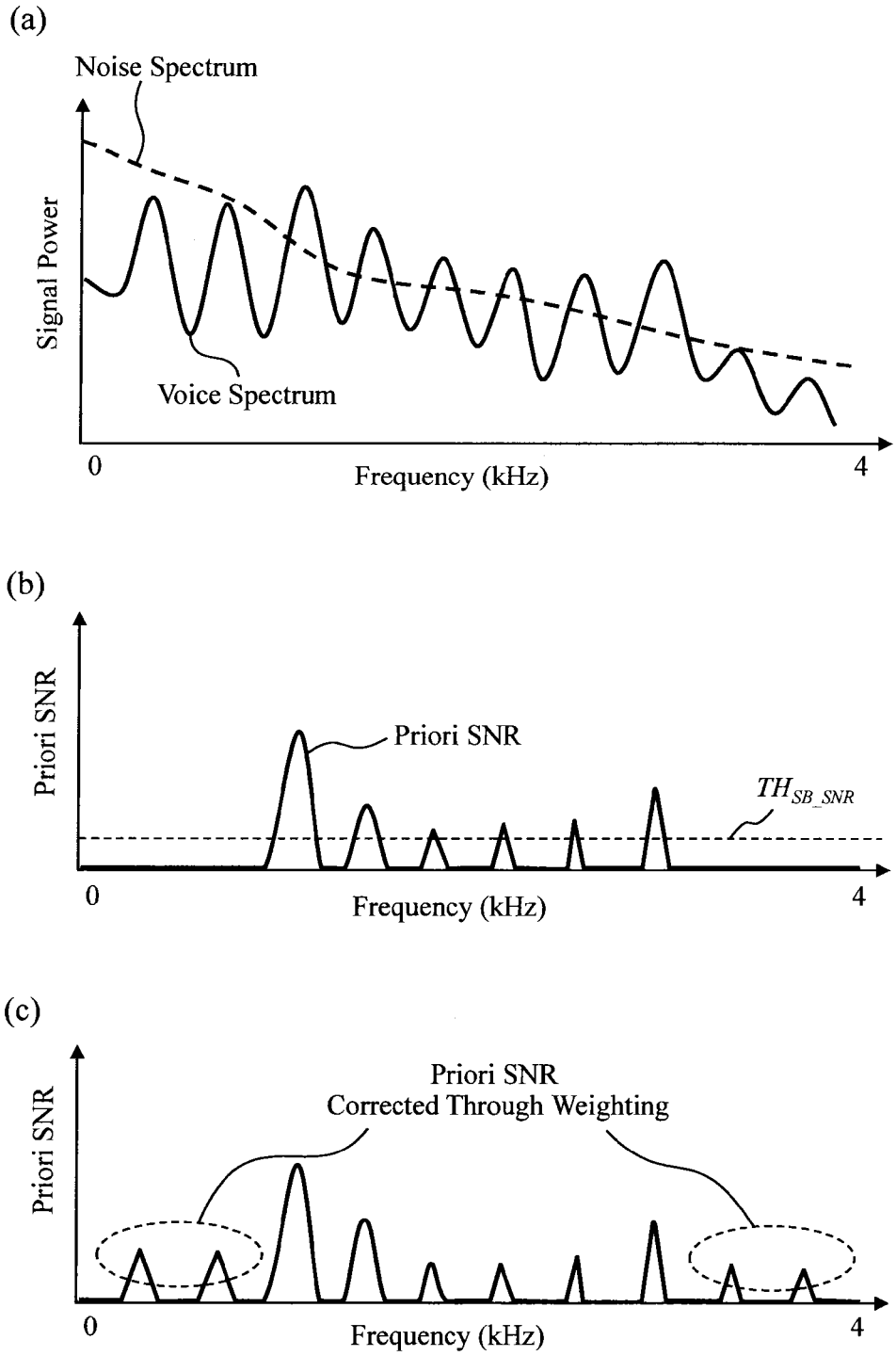
FIG. 4 is an explanatory diagram schematically illustrating a mode of a priori SNR when using a posteriori SNR weighted by a SN ratio calculator of the SN ratio calculator of the noise suppression device according to Embodiment 1.

FIG. 4 schematically illustrates a mode of the priori SNR when using the posteriori SNR weighted on the basis of the weighting coefficient W(λ,k). FIG. 4(*a*) depicts the same waveform as FIG. 3, and shows a relationship between voice spectra and noise spectra. FIG. 4(*b*) depicts a mode of the priori SNR when no weighting is performed. FIG. 4(*c*) depicts a mode of the priori SNR when weighting is performed. The threshold value $TH_{SB_SNR}$ is shown in FIG. 4(*b*) for explaining the method. Comparing FIG. 4(*b*) and FIG. 4(*c*), it is understood that the SN ratio in FIG. 4(*b*) cannot be extracted well at peak portions of voice spectra buried in noise. In contrast, the SN ratio in FIG. 4(*c*) can be extracted well at peak portions, and the SN ratio at the peak portions beyond the threshold value $TH_{SB_SNR}$ are not excessively high such that the operation is performed preferably.

In Embodiment 1, the weighting is performed only on the posteriori SNR. Alternatively, weighting may be performed on the priori SNR or on both of the posteriori SNR and the priori SNR. In those cases, the constant in the above formula (9) may be changed to suit the weighting on the priori SNR.

The foregoing posteriori SNR γ(λ,k) and priori SNR ξ(λ,k) are output to the suppression amount calculator 9, and the priori SNR ξ(λ,k) is also output to the weighting coefficient calculator 7 as the SN ratio for each spectral component.

The suppression amount calculator 9 calculates the spectrum suppression amount G(λ,k), which is the noise suppression amount for each spectra, by using the priori SNR and posteriori SNR γ(λ,k) output from the SN ratio calculator 8, and outputs the calculated spectrum suppression amount G(λ,k) to the spectrum suppression unit 10.

As a method for calculating the spectrum suppression amount G(λ,k), for instance, Joint MAP method may be used. The Joint MAP method is a method of estimating the spectrum suppression amount G(λ,k) on an assumption that the noise signal and the voice signal are in Gaussian distribution. According to the Joint MAP method, the amplitude spectra and the phase spectra which maximize a conditional function of probability density are calculated by using the priori SNR ξ(λ,k) and the posteriori SNR γ(λ,k), and the calculated values are used for the estimated values of G(X,k). The spectrum suppression amount can be expressed as a formula (12) shown below, in which "ν" and "μ" are used as parameters to specify the shape of the function of probability density. Note that the following "Reference Literature 1" describes the detail of a spectrum suppression amount deriving method according to the Joint MAP method, and explanation thereabout is omitted here.

$$G(\lambda, k) = u(\lambda, k) + \sqrt{u^2(\lambda, k) + \frac{v}{2\gamma(\lambda, k)}} \tag{12}$$

$$u(\lambda, k) = \frac{1}{2} - \frac{\mu}{4\sqrt{\gamma(\lambda, k)\xi(\lambda, k)}}$$

Reference Literature 1

T. Lotter, P. Vary, "Speech Enhancement by MAP Spectral Amplitude Estimation Using a Super-Gaussian Speech Model", EURASIP Journal on Applied Signal Processing, pp. 1110-1126, No. 7, 2005

In accordance with a formula (13) shown below, the spectrum suppression unit 10 suppresses the input signal for each spectra, and obtains voice signal spectra S(λ,k) whose noise have been suppressed, and outputs it to the inverse Fourier transformer 11.

$$S(\lambda,k)=G(\lambda,k)\cdot Y(\lambda,k) \tag{13}$$

The inverse Fourier transformer 11 performs an inverse Fourier transformation on the obtained voice signal spectra S(λ,k) to superpose them with an output signal of the previous frame. After that, the output terminal 12 outputs the voice signal s(t) whose noise has been suppressed.

Figure 5:
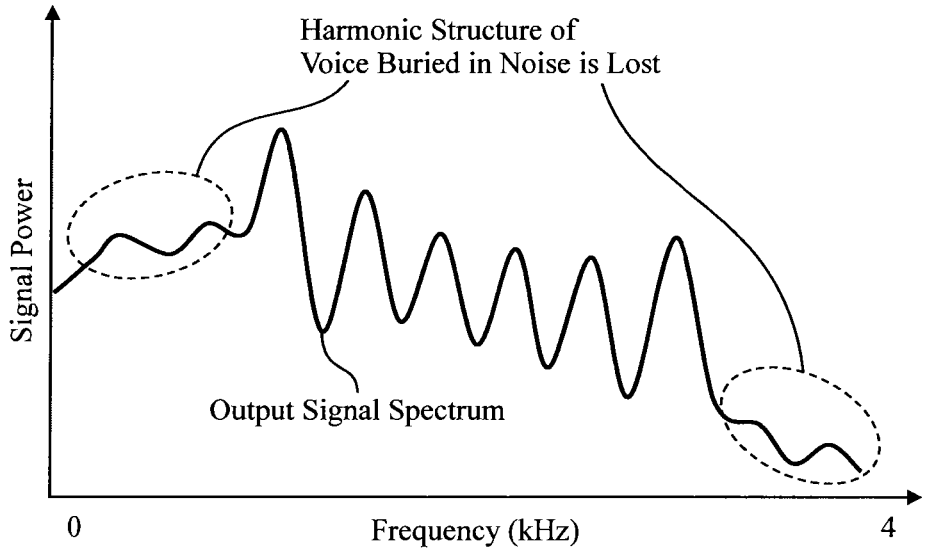
FIG. 5 is a figure illustrating an example of an output result of the noise suppression device according to Embodiment 1.
Figure 5:
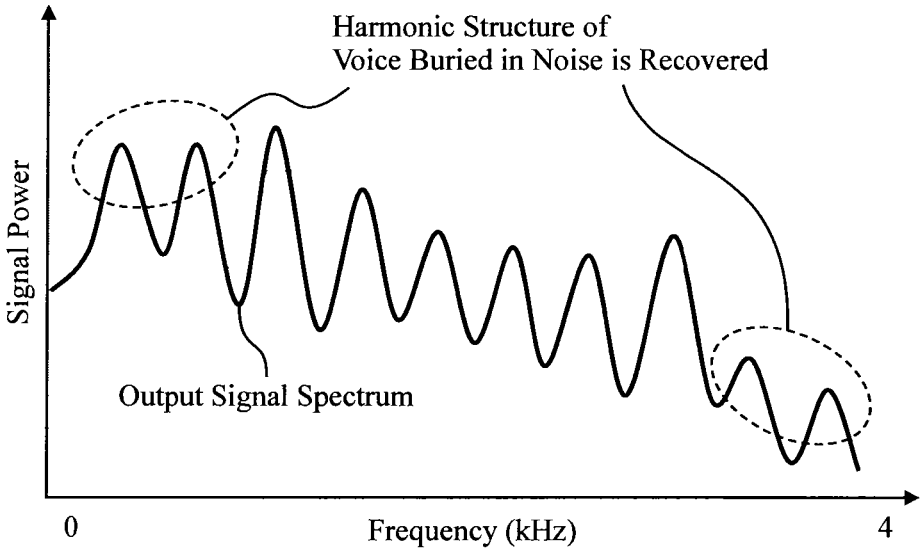

FIG. 5 schematically illustrates spectra of an output signal of a voice section, which is suggested as an example of an output result of the noise suppression device according to Embodiment 1. FIG. 5(*a*) depicts an output result according to a conventional method in which the SN ratio is not weighted according to the formula (10) when the spectra as shown in FIG. 2 is used as an input signal. FIG. 5(*b*) depicts an output result when the ratio is weighted according to the formula (10). In FIG. 5(*a*), the harmonic structure of voice is lost at frequency bands where the voice buries in noise. In contrast, the harmonic structure of voice in FIG. 5(*b*) is recovered at the frequency bands where the voice buries in noise. It represents that the noise suppression is performed preferably.

As described above, according to Embodiment 1, even in a frequency band where voice is buried in noise and SN ratio indicates negative value, the SN ratio is estimated with correcting the harmonic structure of voice to maintain it. Therefore, excessive suppression of the voice can be avoided, and high quality noise suppression can be achieved.

According to Embodiment 1, since the harmonic structure of voice buried in noise can be corrected by weighting the SN ratio, it is not necessary to generate a quasi-low frequency region signal and the like. Therefore, high quality noise suppression can be achieved with a small amount of processing and a small amount of memory.

Furthermore, according to Embodiment 1, since the weighting is controlled by using the SN ratio for each spectral component of the previous frame and the voice/noise section determination flag, there are advantages of avoiding unnecessary weighting in a frequency band having a high SN ratio or being a noise section, and achieving higher quality noise suppression.

In Embodiment 1, although the harmonic structure of both of the low frequency region and the high frequency region is corrected, an embodiment of the present invention is not limited to it. As necessary, only the low frequency region or only the high frequency region may be corrected. Alternatively, for example, a particular frequency band such as only a band from 500 Hz to 800 Hz may be corrected. This kind of correction of the frequency band is effective for correcting voice buried in narrow-band noise such as wind noise and car engine noise.

Embodiment 2

In Embodiment 1 explained above, the value of weighting is kept in constant along a frequency direction as shown in the formula (9). Embodiment 2 presents a configuration for making the value of weighting different in a frequency direction. For example, as a general feature of voice, the harmonic structure in the low frequency region is clear. Therefore, the weighting may be increased in the low frequency region, whereas the weighting can be decreased as the frequency increases. Constituent elements of the noise suppression device according to Embodiment 2 are the same as those of Embodiment 1, and explanation thereabout is omitted.

As described above, Embodiment 2 is configured such that different weighting is applied for each frequency in estimation of the SN ratio. Therefore, suitable weighting can be achieved for each frequency of voice, and still higher quality noise suppression can be achieved.

Embodiment 3

Embodiment 1 explained above shows a configuration in which the value of weighting is a predetermined constant as shown in the formula (9). Embodiment 3 presents a configuration in which multiple weighting constants are switched in accordance with an index of voice probability as to an input signal, or are controlled through a predetermined function.

The index of voice probability as to the input signal, that is, a control factor of mode of the input signal, may be configured such that, when the maximum value of the autocorrelation coefficient is high in the formula (4), that is, when the period structure of the input signal is clear (i.e. it is highly possible that the input signal is voice), the weighting may be increased, whereas the weighting may be decreased when the period structure of the possibility is low. Alternatively, the autocorrelation function and the voice/noise section determination flag may be used together. Constituent elements of the noise suppression device according to Embodiment 3 are the same as those of Embodiment 1, and explanation thereabout is omitted.

As described above, Embodiment 3 is configured such that the value of the weighting constant is controlled in accordance with the mode of the input signal. Therefore, when it is highly possible that the input signal is voice, the weighting can be performed so that the periodicity structure of the voice is emphasized. This can avoid a degradation of voice, while noise suppression in higher quality can be achieved.

Embodiment 4

Figure 6:
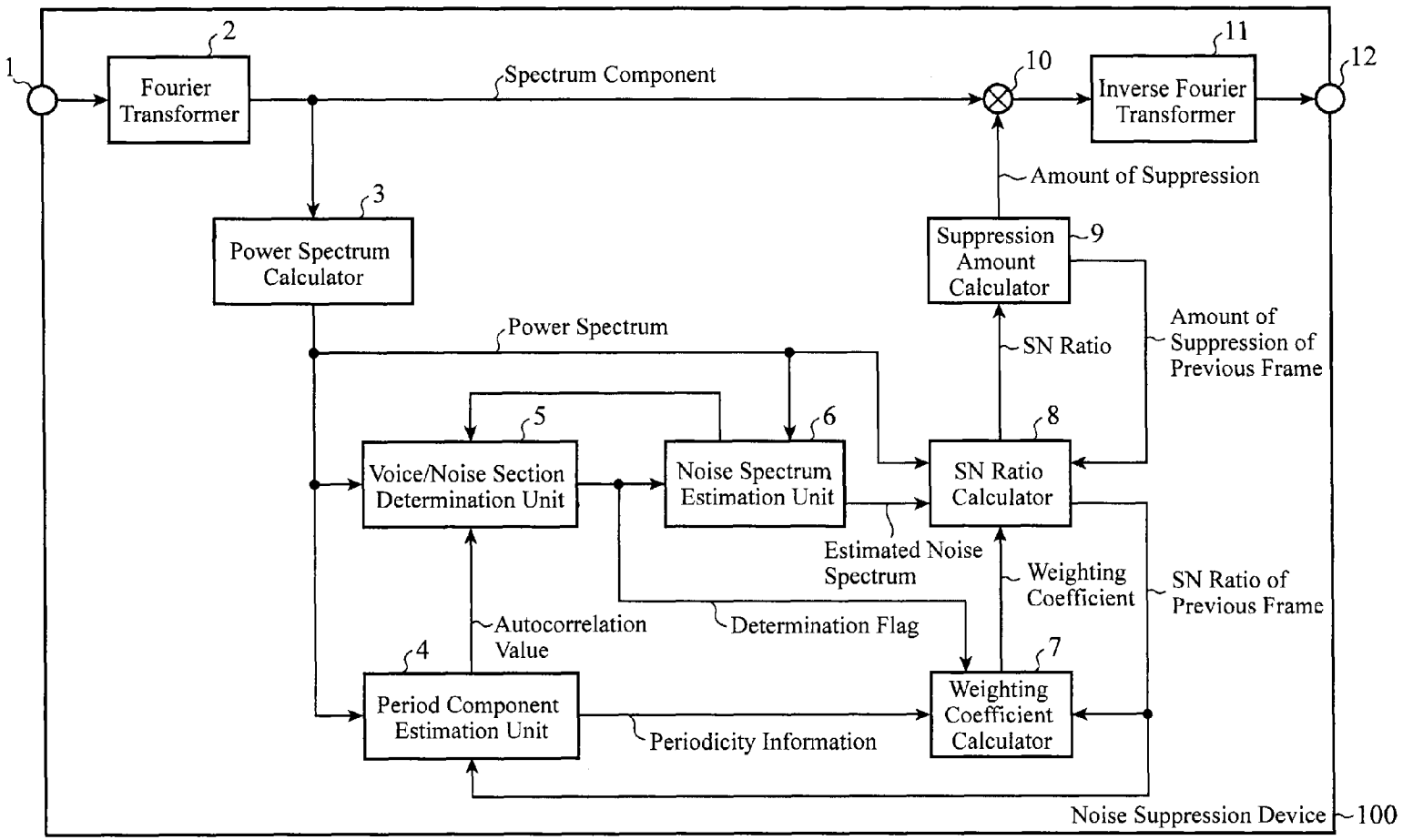
FIG. 6 is a block diagram illustrating a configuration of a noise suppression device according to Embodiment 4.

FIG. 6 is a block diagram illustrating a configuration of a noise suppression device according to Embodiment 4 of the present invention.

Embodiment 1 explained above is configured to detect all the spectral peaks for estimating period components. In Embodiment 4, the SN ratio of a previous frame calculated by the SN ratio calculator 8 is output to the period component estimation unit 4, and the period component estimation unit 4 detects spectral peaks only in a frequency band in which the SN ratio is high by using the SN ratio of the previous frame. Likewise, in the calculation of the normalized autocorrelation function $\rho_N(\lambda,\tau)$, the calculation can be performed only in a frequency band in which the SN ratio is high. The other configuration is the same as the noise suppression device according to Embodiment 1, and explanation thereabout is omitted.

As described above, according to Embodiment 4, the period component estimation unit 4 is configured to detect a spectral peak only in a frequency band in which the SN ratio is high by using the SN ratio of the previous frame received from the ratio calculator 8, or calculate the normalized autocorrelation function only in a frequency band in which the SN ratio is high. Therefore, the detection accuracy of the spectral peaks and the accuracy of voice/noise section determination can be enhanced, and thereby higher quality noise suppression can be achieved.

Embodiment 5

Embodiments 1 to 4 explained above are configured to apply a weighting of the SN ratio so that the weighting coefficient calculator 7 emphasizes the spectral peaks. On the contrary, Embodiment 5 presents a configuration in which weighting is performed to emphasize trough portions of the spectra, that is, to reduce the SN ratio in the troughs of the spectra.

The troughs of the spectra may be detected by regarding a central value of spectrum numbers between spectral peaks as a trough portion of the spectra. The other configuration is the same as the noise suppression device according to Embodiment 1, and explanation thereabout is omitted.

As described above, according to Embodiment 5, since the weighting coefficient calculator 7 performs the weighting to reduce the SN ratio at the troughs of the spectra, the frequency structure of voice can be emphasized, and thereby higher quality noise suppression can be achieved.

In Embodiments 1 to 5 explained above, the maximum posteriori probability method (Joint MAP method) is used for the noise suppression, however, other methods may be used. For example, there is a minimum mean square error short-time spectral amplitude method which is described in Non-Patent Literature 1, or a spectral subtraction method described in Reference Literature 2 shown below.

Reference Literature 2

S. F. Boll, "Suppression of Acoustic Noise in Speech Using Spectral Subtraction", IEEE Trans. on ASSP, Vol. ASSP-27, No. 2, pp. 113-120, April 1979

In Embodiments 1 to 5, each is applied to a narrow-band telephone (0 to 4000 Hz), however, an embodiment of the present invention is not limited to the narrow-band telephone. For example, this can also be applied to voice and acoustic signals of a wide-band telephone supporting 0 to 8000 Hz.

In each of the above embodiments, the output signal whose noise has been suppressed is transmitted in a digital data format to various kinds of voice acoustic processing apparatuses such as a voice encoding apparatus, a voice recognition apparatus, a voice accumulation apparatus, and a hands-free communication apparatus. The noise suppression device 100 according to each embodiment may be achieved independently or together with other apparatuses explained above by a DSP (digital signal processing processor), or may be achieved by executing software programs. The programs may be stored to a storage apparatus of a computer apparatus executing the software programs, or may be distributed as a storage medium such as a CD-ROM. Alternatively, the program may be provided via a network. The output signal is transmitted to various kinds of voice acoustic processing apparatuses, or it may be amplified by an amplification apparatus after D/A (digital/analog) converting, and directly output from a speaker as a voice signal.

Embodiments 1 to 5 explained above present configurations in which the SN ratio as a ratio of the power spectra of voice to the estimated noise power spectra is used as signal information of the power spectra. Besides the SN ratio, for example, only the power spectra of the voice may be used, or a ratio between an estimated noise power spectra and a spectra obtained by subtracting the estimated noise power spectra from the power spectra of voice (i.e. power spectra of voice on an assumption that there is no noise) may be used.

Note that, in the invention of the present application, each embodiment can be freely combined, any constituent element of each embodiment can be modified, or any constituent element of each embodiment can be omitted, within the scope of the invention.

INDUSTRIAL APPLICABILITY

The noise suppression device of the present invention can be used to improve a recognition rate of a voice recognition system and improve a sound quality of a voice communication system such as a mobile phone and an intercom, a TV conference system, a monitoring system, and a car navigation to which a voice communication, a voice storage, and a speech recognition system are introduced, and which suppresses background noise mixed with an input signal.

The invention claimed is:

1. A noise suppression device comprising:

a transformer, of a processor, configured to transform an input signal of time domain into spectral components of the input signal;

a power spectrum calculator configured to convert the spectral components into power spectra;

a voice/noise determination unit configured to determine whether the power spectra indicate voice or noise;

a noise spectrum estimation unit configured to estimate noise spectra of the power spectra by using a determination result of the voice/noise determination unit;

a period component estimation unit configured to analyze a harmonic structure constituting the power spectra, and estimate periodical information about the power spectra;

a weighting coefficient calculator configured to calculate a weighting coefficient for weighting the power spectra by using the periodical information, the determination result of the voice/noise determination unit, and signal information about the power spectra;

a suppression coefficient calculator configured to calculate a suppression coefficient for suppressing noise included in the power spectra by using the power spectra, the noise spectra estimated by the noise spectrum estimation unit, and the weighting coefficient;

a spectrum suppression unit configured to suppress amplitude of the power spectra in accordance with the suppression coefficient; and a transformer configured to convert the power spectra whose amplitude has been suppressed by the spectrum suppression unit into a signal of time domain to generate a noise-suppressed signal.

2. The noise suppression device according to claim 1, wherein the suppression coefficient calculator is configured to calculate a signal-to-noise ratio for each power spectrum as the signal information about the power spectra, and the weighting coefficient calculator is configured to calculate the weighting coefficient corresponding to the signal-to-noise ratio.

3. The noise suppression device according to claim 1, wherein the weighting coefficient calculator is configured to calculate a weighting coefficient whose weighting intensity is controlled in accordance with the determination result of the voice/noise determination unit.

4. The noise suppression device according to claim 2, wherein the suppression coefficient calculator is configured to calculate a signal-to-noise ratio of each power spectrum of a frame previous to a current frame, and the weighting coefficient calculator is configured to calculate a weighting coefficient whose weighting intensity is controlled in accordance with the signal-to-noise ratio of the previous frame.

5. The noise suppression device according to claim 1, wherein the weighting coefficient calculator is configured to calculate a weighting coefficient whose weighting intensity is controlled in accordance with a component of frequency band of the power spectra.

* * * * *